US007976645B2

(12) United States Patent
Ushigami et al.

(10) Patent No.: US 7,976,645 B2
(45) Date of Patent: Jul. 12, 2011

(54) METHOD OF PRODUCTION OF GRAIN-ORIENTED ELECTRICAL STEEL SHEET HAVING A HIGH MAGNETIC FLUX DENSITY

(75) Inventors: Yoshiyuki Ushigami, Tokyo (JP); Norikazu Fujii, Tokyo (JP); Tomoji Kumano, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 250 days.

(21) Appl. No.: 12/227,459

(22) PCT Filed: May 23, 2007

(86) PCT No.: PCT/JP2007/060941

§ 371 (c)(1),
(2), (4) Date: Nov. 17, 2008

(87) PCT Pub. No.: WO2007/136137

PCT Pub. Date: Nov. 29, 2007

(65) Prior Publication Data

US 2009/0126832 A1 May 21, 2009

(30) Foreign Application Priority Data

May 24, 2006 (JP) ..... 2006-144062

(51) Int. Cl.
*H01F 1/147* (2006.01)

(52) U.S. Cl. ..... 148/111; 148/308

(58) Field of Classification Search ..... None
See application file for complete search history.

(56) References Cited

U.S. PATENT DOCUMENTS

2009/0165895 A1* 7/2009 Ushigami et al. ..... 148/208

FOREIGN PATENT DOCUMENTS

| | | |
|---|---|---|
| EP | 1 162 280 | 12/2001 |
| EP | 1179603 | 2/2002 |
| JP | 62-040315 | 2/1987 |
| JP | 02-077525 | 3/1990 |
| JP | 02-182866 | 7/1990 |
| JP | 09-256051 | 9/1997 |
| JP | 9-296219 | 11/1997 |
| JP | 11-181524 | 7/1999 |

(Continued)

OTHER PUBLICATIONS

Machine Translation of JP 2002-060842.*

(Continued)

*Primary Examiner* — John P Sheehan
(74) *Attorney, Agent, or Firm* — Kenyon & Kenyon LLP

(57) ABSTRACT

In a production of grain-oriented electrical steel sheet that is heated at a temperature of not higher than 1350° C., (a) the hot-rolled sheet is heated to a prescribed temperature of 1000° C. to 1150° C., and after recrystallization is annealed for a required time at a lower temperature of 850° C. to 1100° C., or (b) in the hot-rolled sheet annealing process decarburization is conducted to adjust the difference in the amount of carbon before and after decarburization to 0.002 to 0.02 mass %. In the temperature elevation process used in the decarburization annealing of the steel sheet, heating is conducted in the temperature range of 550° C. to 720° C. at a heating rate of at least 40° C./s, preferably 75 to 125° C./s, utilizing induction heating for the rapid heating used in the temperature elevation process in decarburization annealing.

9 Claims, 4 Drawing Sheets

FOREIGN PATENT DOCUMENTS

| | | |
|---|---|---|
| JP | 2000-178648 | 6/2000 |
| JP | 2001-152250 | 6/2001 |
| JP | 2002-060842 | 2/2002 |
| JP | 2003-3215 | 1/2003 |
| JP | 2005-226111 | 8/2005 |
| KR | 10-0442100 | 12/2001 |
| KR | 10-0442101 | 2/2002 |

OTHER PUBLICATIONS

Machine Translation of JP 2001-152250.*

Ushigami, Y., et al., "Precipitation Behaviors of Injected Nitride Inhibitors during Secondary Recrystallization Annealing in Grain Oriented Silicon Steel," *Materials Science Forum*, vols. 204-206 (1996) pp. 593-598.

International Search Report dated Sep. 4, 2007 issued in corresponding PCT Application No. PCT/JP2007/060941.

European Scarch Report in European Application No. 07 744 360.4 dated Jul. 21, 2010.

* cited by examiner

METHOD OF PRODUCTION OF GRAIN-ORIENTED ELECTRICAL STEEL SHEET HAVING A HIGH MAGNETIC FLUX DENSITY

FIELD OF THE INVENTION

This invention relates to a method of using low temperature slab heating to manufacture grain-oriented electrical steel sheet used as soft magnetic material in the cores of electrical equipment such as transformers.

DESCRIPTION OF THE RELATED ART

Grain-oriented electrical steel sheet is steel sheet containing up to 7% Si that is composed of crystal grains concentrated in the {110} <001> direction. Controlling the crystal orientation in the manufacture of this grain-oriented electrical steel sheet is achieved by utilizing a catastrophic grain growth phenomenon called secondary recrystallization.

A method of controlling this secondary recrystallization that is practiced industrially is to produce a fine precipitate called an inhibitor by effecting complete solid solution slab heating prior to hot rolling, followed by hot rolling and annealing. In this method, for complete solid solution heating the precipitate has to be heated at a high temperature of 1350° C. to 1400° C. or above, which is about 200° C. higher than the slab heating temperature of ordinary steel and therefore requires the use of a special heating furnace, while the large amount of molten scale is a further problem.

Thus, research and development have been carried out with respect to manufacturing grain-oriented electrical steel sheet using low temperature slab heating.

In Japanese Patent Publication (B) No. 62-45285, Komatsu et al. disclose a manufacturing method using low temperature slab heating that uses as an inhibitor (Al, Si)N formed by nitriding. As the nitriding method, in Japanese Patent Publication (A) No. 2-77525, Kobayashi et al. disclose a method of nitriding strips following decarburization annealing, and in "Materials Science Forum," 204-206 (1996), pages 593 to 598, the present inventors report on the behavior of the nitrides when nitriding in strips is used.

Also, in Japanese Patent Publication (A) No. 2001-152250 the present inventors reported a manufacturing method in which, following complete solution heating at a temperature of 1200° C. to 1350° C., the inhibitor is formed by nitriding.

In Japanese Patent Publication (B) No. 8-32929, also, the present inventors disclosed a method of manufacturing grain-oriented electrical steel sheet using low temperature slab heating, in which it was shown that because an inhibitor is not formed during decarburization annealing, it is important to adjust the primary recrystallization structure in the decarburization annealing in order to control the secondary recrystallization, and that the secondary recrystallization becomes unstable if the coefficient of variation of the primary recrystallization grain diameter distribution becomes greater than 0.6, resulting in inhomogeneity of the grain structure.

Moreover, as a result of further research into primary recrystallization structure and inhibitors, which are recrystallization control factors, the inventors also found that grains within the primary recrystallization structure having a {411} orientation influence the preferential growth of {110} <001> secondary recrystallization grains, and in Japanese Patent Publication (A) No. 9-256051, showed that grain-oriented electrical steel sheet having a high magnetic flux density could be stably manufactured industrially by adjusting the {111}/{411} ratio of the decarburization-annealed primary recrystallization textures to not more than 3.0, followed by nitriding to reinforce the inhibitor. It was also shown that there was a method of controlling the grain structure following primary recrystallization by, for example, controlling the heating elevation rate during the decarburization annealing process to be 12° C./s or higher.

It was also found that a method of controlling the heating rate was very effective as a method of controlling the recrystallization grain structure. In Japanese Patent Publication (A) No. 2002-60842, the present inventors proposed stabilizing the recrystallization by, in the process of elevating the temperature during the decarburization annealing, controlling the I{111}/I{411} ratio in the decarburization-annealed grain structure to be not more than 3 by heating the steel sheet from a temperature region of not above 600° C. to a prescribed temperature within the range 750° C. to 900° C. at a heating rate of at least 40° C./s and, in the following annealing, adjusting the amount of oxygen in the steel sheet oxidation layer to be not more than 2.3 g/m$^2$.

Here, I{111} and I{411} are the proportion of grains parallel to the respective {111} and {411} planes of the sheet, showing the diffraction intensity measured by X-ray diffraction in a layer that is one-tenth the thickness from the sheet surface.

In the above method, it is necessary to heat to a prescribed temperature within the range 750° C. to 900° C. at a heating rate of at least 40° C./s. This can be done using heating means such as modified decarburization annealing equipment utilizing radiant tubes or other such conventional radiant heating means, methods utilizing a high energy heating source such as a laser, induction heating, ohmic heating equipment, and so forth. Of these heating methods, induction heating is advantageous in that it provides a high degree of freedom with respect to heating rate, enables non-contact heating of the steel sheet, and is relatively easy to install in a decarburization annealing furnace.

However, it is difficult to use induction heating to heat electrical steel sheet to or above the Curie point, since when the temperature reaches close to the Curie point, due to the thinness of the sheet the eddy current penetrates deeper and circles the sectional surface layer part of strip sheet in the transverse direction, causing the eddy currents on the front and back to cancel each other out and stop the flow of eddy current.

The Curie point of grain-oriented electrical steel sheet is in the order of 750° C., so while induction heating may be used to heat the sheet up to that temperature, ohmic heating or other such means has to be used to heat it to higher temperatures.

However, using another heating means in combination loses the advantages of using the induction heating equipment, in addition to which ohmic heating requires contact with the steel sheet, which can damage the sheet.

Thus, when a terminal temperature of the rapid heating region is 750° C. to 900° C. as in the case of Japanese Patent Publication (A) No. 2002-60842, the advantages of induction heating cannot be fully enjoyed.

SUMMARY OF THE INVENTION

In the production of grain-oriented electrical steel sheet using low temperature slab heating at not above 1350° C. disclosed in Japanese Patent Publication (A) No. 2001-152250, the problem was to eliminate the above drawbacks and improve the decarburization-annealed primary recrystallization grain structure, by making the temperature region in which the decarburization annealing heating rate is controlled in the decarburization annealing temperature elevation process, within the range that can be heated using just induction heating.

To resolve the above problem, the method of manufacturing grain-oriented electrical steel sheet of the present invention comprises the following.

1) A method of production of grain-oriented electrical steel sheet comprising: heating silicon steel containing, in mass %, Si: 0.8 to 7%, C: up to 0.085%, acid-soluble Al: 0.01 to 0.065%, N: up to 0.075%, Mn: 0.02 to 0.20%, S eq.=S+0.406×Se: 0.003 to 0.05% to at least any of temperatures T1, T2 and T3 (° C.) represented by formulas set out below and not above 1350° C., followed by hot rolling, annealing hot-rolled sheet thus obtained and subjecting it to one cold rolling or a plurality of cold rollings with intermediate annealing to form steel sheet of a final thickness, decarburization annealing the steel sheet, coating the sheet with an annealing separator, conducting finish annealing and a process to increase an amount of nitrogen in the steel sheet between decarburization annealing and initiation of secondary recrystallization in finish annealing.

wherein after the hot-rolled sheet is recrystallized by being heated to a prescribed temperature of 1000° C. to 1150° C. the sheet is annealed at a lower temperature of 850° C. to 1100° C. to control lamella spacing in the annealed grain structure to be 20 μm or more, and in a temperature elevation process in the decarburization annealing of the steel sheet, the sheet is heated in a temperature range of from 550° C. to 720° C. at a heating rate of at least 40° C./s.

$$T1=10062/(2.72-\log([Al]\times[N]))-273$$

$$T2=14855/(6.82-\log([Mn]\times[S]))-273$$

$$T3=10733/(4.08-\log([Mn]\times[Se]))-273$$

Here, [Al], [N], [Mn], [S], and [Se] are the respective contents (mass %) of acid-soluble Al, N, Mn, S, and Se.

Lamella structure refers to a layered structure parallel to the rolling surface, and the lamella spacing is the average spacing of the layered structure.

2) A method of production of grain-oriented electrical steel sheet comprising: heating silicon steel containing, in mass %, Si: 0.8 to 7%, C: up to 0.085%, acid-soluble Al: 0.01 to 0.065%, N: up to 0.075%, Mn: 0.02 to 0.20%, S equivalent=S+0.406×Se: 0.003 to 0.05% to at least any of temperatures T1, T2 and T3 (° C.) represented by formulas set out below and not above 1350° C., followed by hot rolling, annealing hot-rolled sheet thus obtained and subjecting it to one cold rolling or a plurality of cold rollings with intermediate annealing to form steel sheet of a final thickness, decarburization annealing the steel sheet, coating the sheet with an annealing separator, applying finish annealing and a process to increase an amount of nitrogen in the steel sheet between decarburization annealing and initiation of finish annealing secondary recrystallization, wherein in the hot-rolled sheet annealing process, 0.002 to 0.02 mass % of a pre-decarburization amount of steel sheet carbon is decarburized to control lamella spacing in the annealed surface structure to 20 μm or more and, and in a temperature elevation process in the decarburization annealing of the steel sheet, the sheet is heated in a temperature range of from 550° C. to 720° C. at a heating rate of at least 40° C./s.

$$T1=10062/(2.72-\log([Al]\times[N]))-273$$

$$T2=14855/(6.82-\log([Mn]\times[S]))-273$$

$$T3=10733/(4.08-\log([Mn]\times[Se]))-273$$

Here, [Al], [N], [Mn], [S], and [Se] are the respective contents (mass %) of acid-soluble Al, N, Mn, S, and Se.

The surface layer structure refers to the region from the outermost surface to one-fifth the sheet thickness, and the lamella structure refers to the average spacing of the layered structure parallel to the rolling surface.

The invention of the above 1) or 2) further comprises:

3) said silicon steel that further contains, in mass %, Cu: 0.01 to 0.30% and is hot-rolled after being heated to a temperature that is at least T4 (° C.) below.

$$T4=43091/(25.09-\log([Cu]\times[Cu]\times[S]))-273$$

Here, [Cu] is the Cu content.

4) in the temperature elevation process in the decarburization annealing of the steel sheet, heating of the sheet in a temperature range of from 550° C. to 720° C. at a heating rate of 50 to 250° C./s.

5) in the decarburization annealing of the steel sheet, heating in the range of from 550° C. to 720° C. by induction heating.

6) The present invention further comprises a temperature elevation process of the steel sheet decarburization annealing wherein when the temperature range in which the sheet is heated at said heating rate is made to be from Ts (° C.) to 720° C., a following range from Ts (° C.) to 720° C. is in accordance with a heating rate H (° C./s) from room temperature to 500° C.

$H \leqq 15$: $Ts \leqq 550$ $15 < H$: $Ts \leqq 600$

7) The present invention further comprises the decarburization annealing being carried out at a temperature and length of time whereby the decarburization-annealed primary recrystallization grain diameter is from 7 μm to less than 18 μm.

8) The present invention further comprises the amount of nitrogen [N] of the steel sheet being increased to satisfy the formula $[N] \leqq 14/27\,[A]$ corresponding to the amount of acid-soluble Al [Al] of the steel sheet.

9) The present invention further comprises the silicon steel sheet containing, in mass %, one or more of Cr: up to 0.3%, P: up to 0.5%, Sn: up to 0.3%, Sb: up to 0.3%, Ni: up to 1%, and Bi: up to 0.01%.

In accordance with this invention, by using a two-stage temperature range to conduct hot-rolled sheet annealing in the manufacture of grain-oriented electrical steel sheet using low-temperature slab heating at a temperature of 1350° C. or below or, as described above, using decarburization during hot-rolled sheet annealing to control lamella spacing, the upper limit of the temperature to maintain a high heating rate used in the temperature elevation process of the decarburization annealing to improve the grain structure following primary recrystallization after decarburization annealing can be set to a lower temperature range in which heating can be conducted using just induction heating, making it easier to conduct the heating and easier to obtain grain-oriented electrical steel sheet having good magnetic properties.

Therefore, using induction heating for the above heating provides various effects, such as a high degree of freedom with respect to heating rate, non-contact heating of the steel sheet, and is relatively easy to install in a decarburization annealing furnace.

Moreover, adjusting the decarburization-annealed crystal grain diameter or the nitrogen amount of the steel sheet makes it possible to effect secondary recrystallization more stably, even when the decarburization-annealing heating rate is raised.

The present invention also enables the magnetic characteristics to be improved by the addition of the above-described elements to the silicon steel.

DETAILED DESCRIPTION OF THE INVENTION

In the manufacture of grain-oriented electrical steel sheet using low temperature slab heating of not above 1350° C. disclosed in Japanese Patent Publication (A) No. 2001-152250, the inventors considered that supposing that the lamella spacing in the grain structure of annealed hot-rolled sheet affects the grain structure following primary recrystallization it may be possible to increase the ratio of {411} grains in the primary recrystallization texture even if the temperature at which rapid heating during decarburization annealing is interrupted is decreased (even if interrupted prior to the temperature at which primary recrystallization takes place). They therefore made various changes to the hot-rolled sheet annealing conditions and investigated the relationship between the magnetic flux density B8 of steel sheet following secondary recrystallization and lamella spacing in the grain structure of hot-rolled sheet following annealing, and the relationship between magnetic flux density B8 and heating rate at various temperatures in the temperature elevation process in decarburization annealing.

As a result, the invention was perfected by the finding that in the hot-rolled sheet annealing process, after heating at the prescribed temperature to effect recrystallization then annealing at a lower temperature and controlling the lamella spacing in the annealed grain structure to be 20 μm or more, the temperature region of major structural change in the temperature elevation process of the decarburization annealing was 700° C. to 720° C., and that by heating in the temperature range of 550° C. to 720° C. included therein at a heating rate of at least 40° C./s, preferably 50 to 250° C./s, and more preferably 75 to 125° C./s, it was possible to control the primary recrystallization so that the I{111}/I{411} ratio in the decarburization-annealed texture was not more than a prescribed value, thus making it possible to stably achieve a secondary recrystallization structure.

Lamella spacing is the average spacing of the layered structure called the lamella structure parallel to the rolling surface.

The experiments that provided this finding are described below.

First, the relationship between the hot-rolled sheet annealing conditions and the magnetic flux density B8 of specimens following finish annealing were examined.

Figure 1:
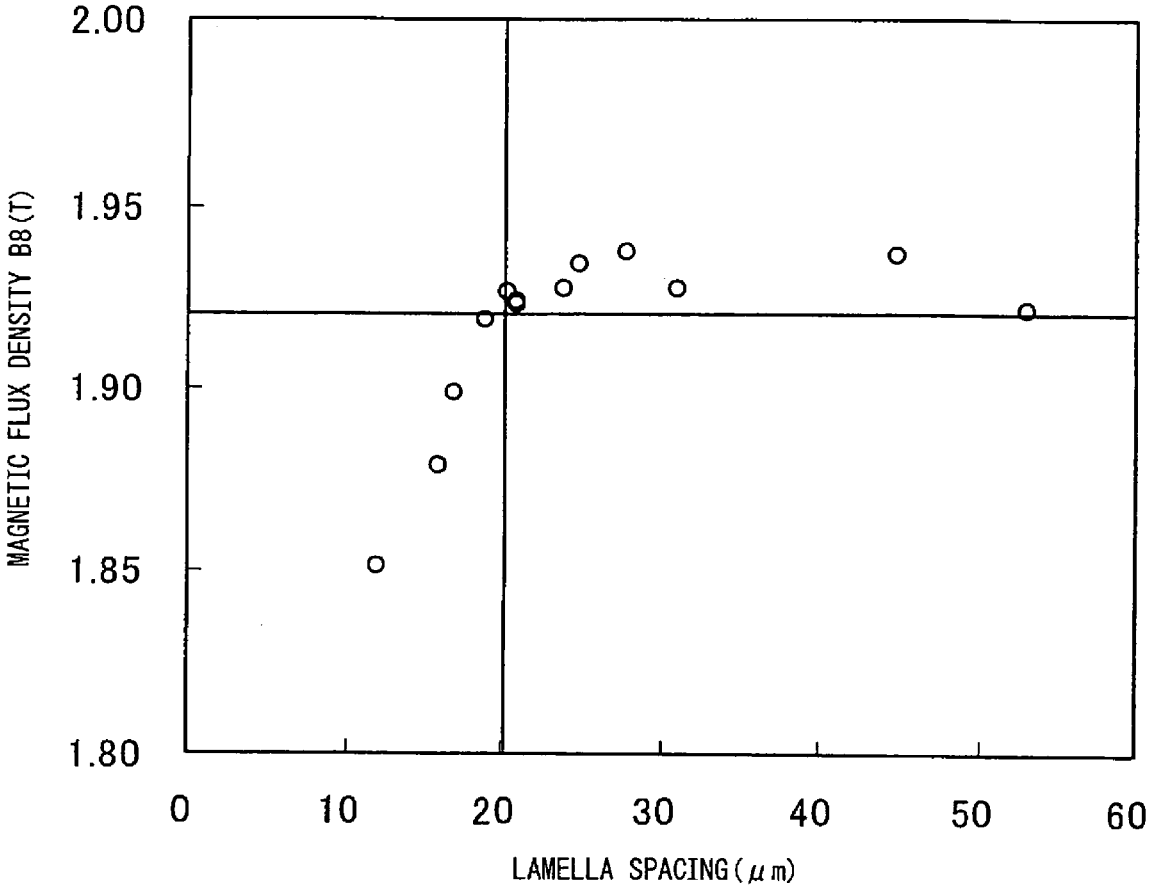
FIG. 1 shows the relationship between lamella spacing in the pre-cold-rolled grain structure of specimens of hot-rolled sheets that have been annealed in a two-stage temperature range, and magnetic flux density B8.

FIG. 1 shows the relationship between lamella spacing in the structure of specimens prior to cold rolling, and the magnetic flux density B8 of specimens that have been finish-annealed.

The specimens that were used were slabs containing, in mass %, Si: 3.2%, C, 0.045 to 0.065%, acid-soluble Al: 0.025%, N: 0.005%, Mn: 0.04%, S: 0.015% and the balance of Fe and unavoidable impurities. The slabs were heated to 1300° C. and hot-rolled to a thickness of 2.3 mm (in the case of this component system, T1=1246° C. and T2=1206° C.). This was followed by recrystallization at 1120° C., and the hot-rolled sheets were then subjected to two-stage annealing at a temperature of 800° C. to 1120° C., and the hot-rolled specimens were then cold rolled to a thickness of 0.3 mm, heated to 550° C. at a heating rate of 15° C., heated from 550° C. to 720° C. at a heating rate of 40° C./s, then heated at a heating rate of 15° C./s to 830° C. for decarburization annealing, annealed in an ammonia atmosphere, subjected to nitriding to increase the nitrogen in the steel sheet, coated with an annealing separator composed principally of MgO, then finish-annealed. The lamella spacing was adjusted by adjusting the amount of C and the second-stage temperature in the two-stage hot-rolled sheet annealing.

As can be seen from FIG. 1, when the lamella spacing was adjusted to 20 μm or more, it was possible to obtain a high magnetic flux density B8 of 1.92 T or higher by elevating the temperature at a heating rate of 40° C./s in the decarburization-annealing temperature region 550° C. to 720° C.

Also, based on an analysis of the primary recrystallization texture of decarburization-annealed sheet specimens from which a B8 of 1.92 T was obtained, it was confirmed that the I{111}/I{411}ratio in all specimens was not more than 3.

Next, an investigation was carried out with respect to the heating conditions during decarburization that would provide steel sheet having a high magnetic flux density (B8), under the condition of the lamella spacing in the grain structure of specimens prior to cold rolling being 20 μm or more.

The specimens used had 0.055% C, and with respect to the hot-rolled sheet annealing temperature, the first-stage temperature was 1120° C. and the second-stage temperature was 920° C., and a lamella spacing of 26 μm was used, other than which cold-rolled specimens were fabricated in the same way as in the case of FIG. 1, and the heating rate was varied in the temperature range 550° C. to 720° C. during the temperature elevation of the decarburization annealing process, and after finish-annealing the magnetic flux density B8 of the specimens was measured.

Figure 2:
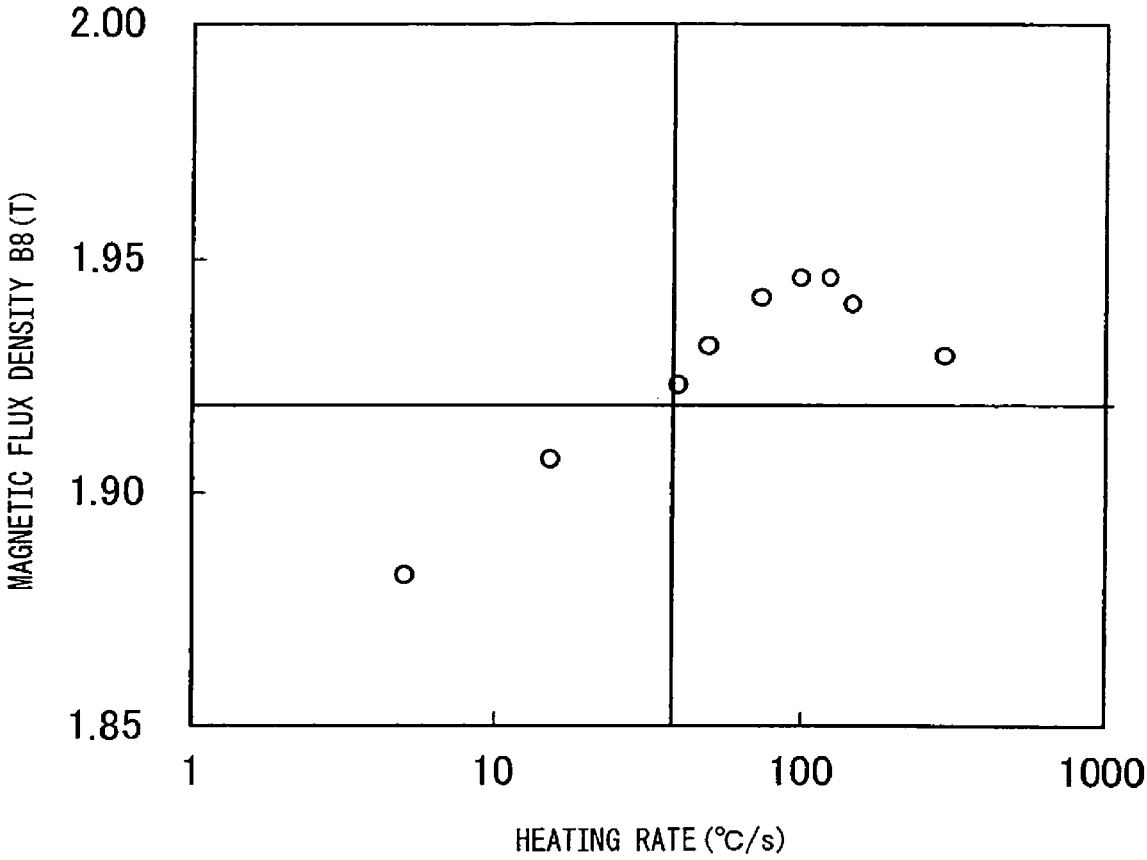
FIG. 2 shows the relationship between heating rate in the temperature range from 550° C. to 720° C. during temperature elevation of the decarburization annealing of specimens of hot-rolled sheets that have been annealed in a two-stage temperature range, and product magnetic flux density (B8).

From FIG. 2, it can be understood that electrical steel sheet having a high magnetic flux density (B8) of 1.92 or higher can be obtained if the heating rate at each temperature in the temperature range from 550° C. to 720° C. in the temperature elevation of the decarburization annealing process is 40° C./s or higher, and that electrical steel sheet having an even higher magnetic flux density (B8) can be obtained by controlling the heating rate to 50 to 250° C./s, and more preferably 75 to 125° C./s.

Consequently, in the process of annealing the hot-rolled sheet, after the sheet is heated to a prescribed temperature of 1000° C. to 1150° C. and recrystallized it is annealed at a lower temperature of 850° C. to 1100° C., and by controlling the lamella spacing in the annealed grain structure to be 20 μm or more, even if the rapid-heating temperature range in the temperature elevation process of the decarburization annealing is within the range 550° C. to 720° C., it is possible to increase the ratio of {411} orientation grains and hold the I{111}/I{411} ratio to be not more than 3, making it possible to stably manufacture grain-oriented electrical steel sheet having a high magnetic flux density.

Since it was confirmed that it was effective to control the lamella spacing in the decarburization-annealed grain structure to be 20 μm or more, as described above, the inventors conducted an examination with respect to other means that control the lamella spacing to be 20 μm or more.

Based on the results of experiments that were similar to the experiments that obtained the above FIGS. 1 and 2, it was found that in the hot-rolled sheet annealing process, lamella spacing in the annealed surface layer grain structure can be controlled to be 20 μm or more by the decarburization of 0.002 to 0.02 mass % of carbon amount, and that even in a case in which that is done, the primary recrystallization can be controlled so that the I{111}/I{411} ratio in the decarburization-annealed grain texture is not more than 3, by heating the steel sheet in a temperature region from 550° C. to 720° C. at a heating rate of at least 40° C./s in the temperature elevation process of the decarburization annealing, enabling the stable achievement of a secondary recrystallization structure.

The surface layer of the surface grain structure refers to the region from the outermost surface to one-fifth the sheet thickness, and the lamella spacing refers to the average spacing of the layered structure parallel to the rolling surface.

Figure 3:
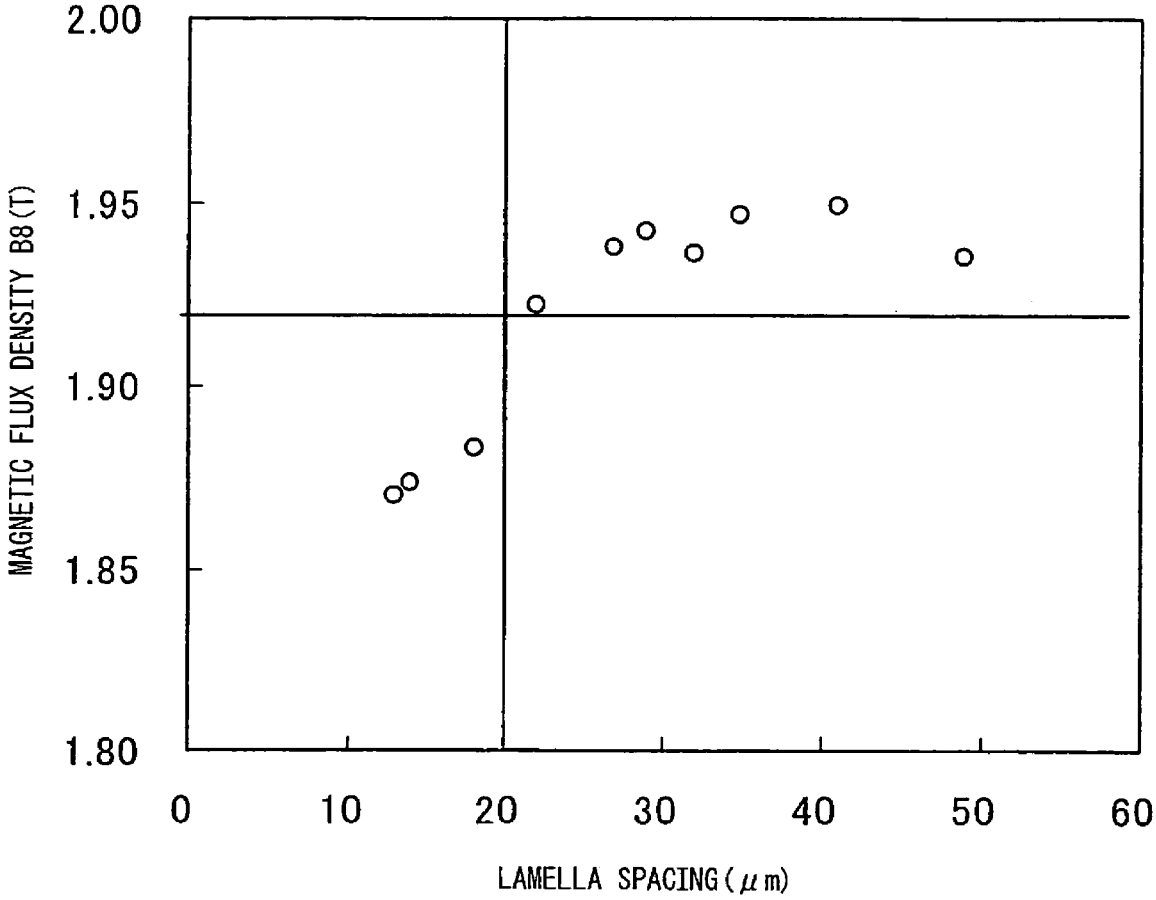
FIG. 3 shows the relationship between lamella spacing of the pre-cold-rolled surface layer grain structure of specimens that have been decarburized during hot-rolled sheet annealing, and magnetic flux density (B8).

FIG. 3 shows the relationship between lamella spacing of the surface layer prior to cold rolling and magnetic flux density B8 after finish-annealing of specimens in which the lamella spacing of the surface grain structure after annealing is changed.

The lamella spacing of the surface layer was adjusted by changing the water vapor partial pressure of the gaseous atmosphere in which hot-rolled sheet annealing was conducted at 1100° C., adjusting the difference in the amount of carbon before and after decarburization to within the range 0.002 to 0.02 mass %.

As can be seen from FIG. 3, a high magnetic flux density B8 of 1.92 or higher can be obtained even when the lamella spacing of the surface layer is made 20 μm or more by the decarburization in the hot-rolled sheet annealing process.

Figure 4:
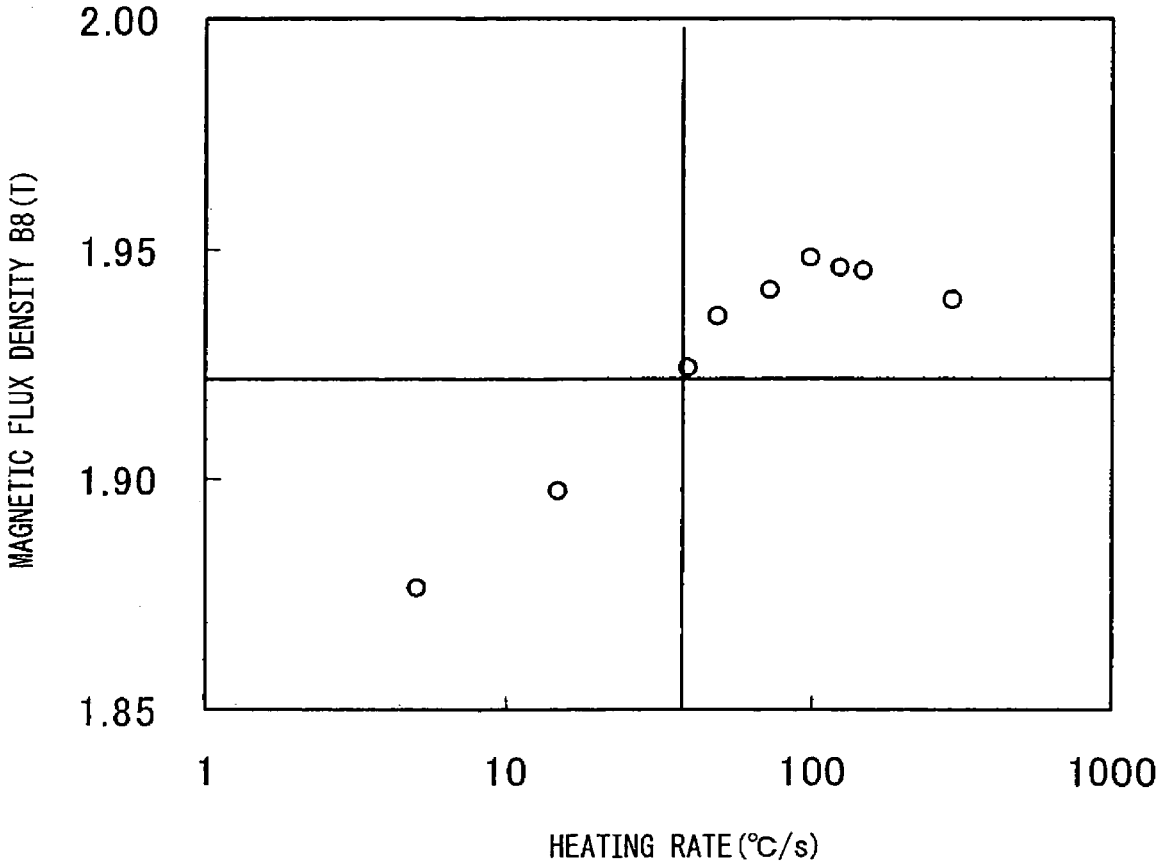
FIG. 4 shows the relationship between heating rate in the temperature range from 550° C. to 720° C. during temperature elevation of the decarburization annealing of specimens that have been decarburized during hot-rolled sheet annealing, and magnetic flux density (B8).

FIG. 4 shows the relationship between heating rate and the magnetic flux density B8 of cold-rolled specimens fabricated in the same way as those in FIGS. 1 and 2 in which the oxidation degree of the gaseous atmosphere used in the hot-rolled sheet annealing was adjusted to form a surface layer grain structure having a lamella spacing of 28 μm, when the heating rate during decarburization annealing temperature in the region 550° C. to 720° C. is changed to various temperature elevation rates.

From FIG. 4, it can be understood that even when the lamella spacing is controlled by decarburization in the hot-rolled sheet annealing process, electrical steel sheet having a high magnetic flux density more can be obtained when the heating rate at each temperature in the temperature range from 550° C. to 720° C. in the temperature elevation of the decarburization annealing process is at least 40° C./s.

It has not been fully clarified why controlling the lamella spacing in the hot-rolled annealed grain structure of the sheet changes the {411} and {111} textures, but the current theory is as follows.

It is known that there are preferential sites where recrystallization grains are produced and the location of preferential sites depend on the recrystallization orientation. If in the cold-rolling process, recrystallization nuclei are thought of as forming in the lamella structure in the case of {411} and in the vicinity of the lamella in the case of {111}, it is possible to explain the phenomenon that the ratio of {411} and {111} crystal orientation following primary recrystallization can be changed by controlling the lamella spacing of the crystal structure prior to cold rolling.

Also, when (Al, Si)N and AlN are used as inhibitors, these inhibitors weaken from the surface and secondary recrystallization grains having a {110}<001> orientation are produced from the surface layer, so it can be considered important to control the lamella spacing of the surface layer grain structure.

The invention is described below, based on the above findings.

The reason for the limitations on the components of the silicon steel used in the present invention will now be explained.

The present invention uses as the steel material silicon steel slab for grain-oriented electrical steel sheet having a basic composition containing at least, in mass %, Si: 0.8 to 7%, C: up to 0.085%, acid-soluble Al: 0.01 to 0.065%, N: up to 0.0075%, Mn: 0.02 to 0.20%, S equivalent=S+0.406×Se: 0.003 to 0.05% and the balance of Fe and unavoidable impurities, and further containing 0.01 to 0.30 mass % Cu, and other components as required. The reasons for the limitations on the content range of each component are as follows.

Increasing the amount of added Si raises the electrical resistance, improving core loss properties. However, if more than 7% is added, cold rolling becomes very difficult, with the steel cracking during rolling. Up to 4.8% is more suitable for industrial production. If the amount is less than 0.8%, γ transformation takes place during finish annealing, impairing the steel sheet crystal orientation.

C is an effective element for controlling primary recrystallization structure, but also has an adverse effect on magnetic properties, so it is necessary to conduct decarburization before finish annealing. If there is more than 0.085% C, the decarburization annealing time is increased, impairing industrial productivity.

In this invention, acid-soluble Al is a necessary element as it combines with N as (Al, Si)N to function as an inhibitor. The limitation range is 0.01 to 0.065%, which stabilizes secondary recrystallization.

If there is more than 0.012% N, blisters are produced in the steel sheet during cold rolling, so exceeding 0.012% is avoided. To have it function as an inhibitor, up to 0.0075% is necessary. If the amount exceeds 0.0075%, the precipitate dispersion state becomes inhomogeneous, producing secondary recrystallization instability.

If there is less than 0.02% Mn, cracking occurs more readily during hot rolling. As MnS and MnSe, Mn also functions as an inhibitor, but if there is more than 0.20%, dispersions of MnS and MnSe precipitates become inhomogeneous more readily, producing secondary recrystallization instability. The preferable range is 0.03 to 0.09%.

In combination with Mn, S and Se function as inhibitors. The inhibitor function is decreased if S eq.=S+0.406×Se is less than 0.003%. Also, if there is more than 0.05%, dispersion of precipitates becomes inhomogeneous more readily, producing secondary recrystallization instability.

Cu can also be added, as an inhibitor constituent element. Cu forms precipitates with S or Se to thereby function as an inhibitor. The inhibitor function is decreased if there is less than 0.01%. If the added amount exceeds 0.3%, dispersion of precipitates becomes inhomogeneous more readily, producing saturation of the core loss decrease effect.

In addition to the above components, if required, the slab material of the invention may also contain at least one of Cr, P, Sn, Sb, Ni, Bi, in the ranges of Cr: up to 0.3%, P: up to 0.5%, Sn: up to 0.3%, Sb: up to 0.3%, Ni: up to 1%, Bi: up to 0.01%.

Cr improves the decarburization annealing oxidation layer and is an effective element for forming a glass film; up to 0.3% is added.

P is an effective element for raising specific resistance and decreasing core loss. Adding more than 0.5% produces rollability problems.

Sn and Sb are well-known grain boundary segregation elements. The present invention contains Al, so depending on the finish-annealing conditions, water content discharged from the annealing separator may oxidize the Al and vary the inhibitor strength at the coil location, varying the magnetic properties at the coil location. One measure to counter this is a method that uses the addition of these grain boundary segregation elements to prevent oxidation, for which up to 0.30% of each may be added. If the amount exceeds 0.30%, however, oxidation during decarburization annealing becomes more difficult, resulting in an inadequate formation of glass film and a marked impediment to decarburization annealing.

Ni is an effective element for raising specific resistance and reducing core loss. It is also an effective element for controlling the metallographic structure of hot-rolled sheet, improving the magnetic characteristics. However, secondary recrystallization becomes unstable if the added amount exceeds 1%.

When Bi is added up to 0.01%, it has the effect of stabilizing precipitates of sulfides and the like, strengthening the inhibitor function. However, adding more than 0.01% has an adverse effect on glass film formation.

The silicon steel material used in the present invention may also contain, to the extent that it does not impair the magnetic characteristics, elements other than those described above and/or elements admixed with unavoidable impurities.

Next, the manufacturing conditions of the present invention will be explained.

Silicon steel slab having the above-described composition is obtained by using a converter or an electric furnace to produce ingot steel, if necessary subjecting the steel ingots to vacuum degassing, followed by continuous casting or blooming after casting. This is followed by slab heating preceding hot rolling. In this invention, a slab heating temperature of up to 1350° C. is used, which avoids the various problems of high-temperature slab heating (problems such as the need for a special heating furnace, the large amount of molten scale, and so forth).

In this invention, moreover, the lower temperature limit of the slab heating needs to be one at which inhibitors (AlN, MnS, and MnSe, etc.) are completely in solution. For this, it is necessary to set the slab heating temperature to be at least any of temperatures T1, T2, and T3 (° C.) represented by the following formulas, and to control the constituent element amounts of the inhibitors. With respect to the Al and N contents, it is necessary for T1 to reach not above 1350° C. Similarly, with respect to the Mn and S contents, the Mn and Se contents, and the Cu and S contents, it is necessary for T2, T3, T4 to reach not above 1350° C.

$$T1=10062/(2.72-\log([Al]\times[N]))-273$$

$$T2=14855/(6.82-\log([Mn]\times[S]))-273$$

$$T3=10733/(4.08-\log([Mn]\times[Se]))-273$$

$$T4=43091/(25.09-\log([Cu]\times[Cu]\times[S]))-273$$

Here, [Al], [N], [Mn], [S], and [Se] are the respective contents (mass %) of acid-soluble Al, N, Mn, S, and Se.

The silicon steel slabs are generally cast to a thickness in the range 150 to 350 mm, and more preferably 220 to 280 mm, but may be cast as so-called thin slabs in the range 30 to 70 mm. An advantage in the case of thin slabs is that it is not necessary to carry out roughing to an intermediate thickness when manufacturing hot-rolled sheet.

Slabs heated at the above temperatures are then hot-rolled to form hot-rolled sheet of a required thickness.

In this invention, (a) the hot-rolled sheet is heated to a prescribed temperature of 1000° C. to 1150° C., and after recrystallization is annealed for a required time at a lower temperature of 850° C. to 1100° C. Otherwise, (b) in the hot-rolled sheet annealing process decarburization is conducted to adjust the difference in the amount of carbon before and after decarburization to 0.002 to 0.02 mass %.

In this way, the grain structure of the annealed steel sheet, or lamella spacing of the grain structure of the steel sheet surface layer, is adjusted to 20 μm or more.

When annealing as in (a), from the viewpoint of promoting the recrystallization of the hot-rolled sheet, the first-stage annealing may be conducted at a heating rate of 5° C./s or higher, and more preferably 10° C./s or higher, at a high temperature of 1100° C. or above for a period of 0 s or more and at a low temperature in the order of 1000° C. and for 30 s or more. From the viewpoint of maintaining lamella structure, cooling following the second-stage annealing may be conducted at a cooling rate of 5° C./s or more, and more preferably 15° C./s or more.

As also described in part in Japanese Patent Publication (A) No. 2005-226111, the object of the two-stage hot-rolled sheet annealing is to adjust the inhibitor state, but nothing is suggested with respect to whether it is possible to increase the ratio of grains having an orientation in which secondary recrystallization readily takes place following primary recrystallization, even when the rapid heating range in the temperature elevation process of the decarburization annealing is set at a lower temperature range, when manufacturing grain-oriented electrical steel sheet by the above-described latter method by using two-stage hot-rolled sheet annealing to control the lamella spacing in the annealed grain structure, as in the present patent application.

Also, in a case in which decarburization is conducted in the hot-rolled sheet annealing process, as in (b), publicly-known treatment methods that can be used include a method in which the oxidation degree is adjusted by having the gaseous atmosphere contain water vapor, and by a method of coating the surface of the steel sheet with a decarburization accelerator ($K_2CO_3$ and $Na_2CO_3$, for example).

The surface-layer lamella spacing in this case is controlled by using a decarburization amount (the difference in the amount of carbon in the steel sheet before and after decarburization) that is within the range 0.002 to 0.02 mass %, and more preferably 0.003 to 0.008 mass %. A decarburization amount of less than 0.002 mass % has no effect on the surface lamella spacing, while 0.02 mass % or more has an adverse effect on the surface texture.

Following that, the sheet is rolled to a final thickness in one cold rolling or two or more cold rollings separated by annealings. The number of cold rolling passes is suitably selected taking into consideration the desired product properties level and cost. In the cold rolling, a final cold rolling reduction ratio of at least 80% is necessary in order to achieve a primary recrystallization orientation such as {411} or {111}.

Steel sheet that has been cold-rolled is subjected to decarburization annealing in a humid atmosphere to remove C contained in the steel. Product having a high magnetic flux density can be stably manufactured by setting the I{111}/

I{411} ratio in the decarburization-annealed grain structure to be not more than 3 and then conducting nitriding treatment prior to the manifestation of secondary recrystallization.

As a method of controlling the primary recrystallization structure after decarburization annealing, it is controlled by adjusting the heating rate in the temperature elevation process of the decarburization annealing. This invention is characterized in that the steel sheet at a temperature between 550° C. and 720° C. is rapidly heated at a heating rate of 40° C./s, preferably 50 to 250° C./s, and more preferably 75 to 125° C./s.

The heating rate has a major effect on the I{111}/I{411} ratio of the primary recrystallization texture. In primary recrystallization, the ease of the recrystallization differs depending on the crystal orientation, so to set I{111}/I{411} to not more than 3, it is necessary to control the heating rate to facilitate the recrystallization of {411} oriented grains. Primary recrystallization of {411} oriented grains occurs most readily at rates in the vicinity of 100° C./s, so to set I{111}/I{411} to not more than 3 for stable manufacture of product having a high magnetic flux density (B8), a heating rate of 40° C./s, preferably 50 to 250° C./s, and more preferably 75 to 125° C./s, is used.

The temperature region required to heat at that heating rate is basically the temperature region from 550° C. to 720° C. Rapid heating can of course be initiated from 550° C. or below to within the above heating rate range. The lower limit temperature of the temperature range at which a high heating rate should be maintained affects the heating cycle at lower temperature regions. Therefore, if the temperature range at which rapid heating is required is from an initial temperature Ts (° C.) to 720° C., the following range from Ts (° C.) to 720° C. may be used in accordance with the heating rate H (° C./s) from room temperature to 500° C.

$H \geqq 15$: $Ts \leqq 550$ $15 < H$: $Ts \leqq 600$

In the case of a standard, low-temperature-region heating rate of 15° C./s, it is necessary to conduct rapid heating at a heating rate of 40° C./s or higher in the range of 550° C. to 720° C. It is also necessary to conduct rapid heating at a heating rate of 40° C./s or higher in the range of 550° C. to 720° C. in the case of a low-temperature-region heating rate that is slower than 15° C./s. On the other hand, in a case in which the low-temperature-region heating rate is faster than 15° C./s, it is enough to conduct rapid heating at a heating rate of 40° C./s or higher in the range of from a temperature that at 600° C. or below is higher than 550° C., to 720° C. When the heating from room temperature has been conducted at 50° C./s, for example, a temperature elevation rate of 40° C./s or higher in the range of 600° C. to 720° C. will suffice.

There is no particular limitation on the method for controlling the decarburization-annealing heating rate, but since in the case of the present invention the upper limit of the rapid-heating temperature range is 720° C., induction heating can be effectively utilized.

As disclosed in Japanese Patent Publication (A) 2002-60842, an effective way to stably utilize the effect of the adjusting of the above heating rate is, after heating, in the temperature region 770 to 900° C., to effect a gaseous atmosphere oxidation degree ($PH_2O/PH_2$) that is over 0.15 and not over 1.1, for a steel-sheet oxygen amount of 2.3 g/m$^2$. If the oxidation degree of the gaseous atmosphere is lower than 0.15, it will degrade the adhesion of the glass film that forms on the steel sheet surface, while if it is higher than 1.1, it produces defects in the glass film. Setting the oxygen amount of the steel sheet to not more than 2.3 g/m$^2$ suppresses the decomposition of the (Al, Si)N inhibitor, enabling the stable manufacture of grain-oriented electrical steel sheet product having a high magnetic flux density.

Also, as disclosed in Japanese Patent Publication (A) No. 2001-152250, by conducting decarburization annealing heating at a temperature and length of time that produces a primary recrystallization grain diameter of 7 to 18 μm, secondary recrystallization can be more stably manifested, enabling the manufacture of even more excellent grain-oriented electrical steel sheet.

Nitriding process methods for increasing the nitrogen include a method in which, following on from the decarburization annealing, annealing is done in an atmosphere containing a gas having nitriding ability such as ammonia, and a method of effecting it during finish annealing by adding a powder having nitriding such as MnN to the annealing separator.

For more stable secondary recrystallization when an rapid heating rate is used for decarburization annealing, it is desirable to adjust the composition ratio of the (Al, Si)N, and with respect to the nitrogen amount after nitriding, for the ratio of the nitrogen amount: [N] to the Al amount in the steel: [Al], that is [N]/[Al], to be at least 14/27 in terms of mass ratio.

Next, an annealing separator having magnesia as its main component is applied, after which finish annealing is carried out to effect preferential growth of {110} <001> oriented grains by secondary recrystallization.

As described in the foregoing, in the present invention, grain-oriented electrical steel sheet is manufactured by heating silicon steel to at least a temperature at which prescribed inhibitors are completely in solution and is also heated at a temperature that is not above 1350° C., hot-rolled and hot-rolled sheet annealed, followed by one cold rolling or a plurality of cold rollings separated by annealings to a final thickness, decarburization-annealed, coated with an annealing separator and finish-annealed, and in the interval from decarburization annealing to the start of the finish-annealing secondary recrystallization, the steel sheet is subjected to nitriding treatment. It was possible to manufacture grain-oriented electrical steel sheet having a high magnetic flux density by controlling the lamella spacing of the grain structure (or of the grain structure of the surface layer) of the steel sheet following hot-rolled sheet annealing to be 20 μm or more by (a) heating the hot-rolled annealed sheet to a prescribed temperature of 1000° C. to 1150° C. to effect recrystallization, followed by annealing at a lower temperature of 850° C. to 1100° C., or (b) using decarburization in the hot-rolled sheet annealing process to adjust the difference in the amount of carbon before and after decarburization to 0.002 to 0.02 mass %, and by also, in the temperature elevation process used in the decarburization annealing of the steel sheet, by heating in the temperature range of 550° C. to 720° C. at a heating rate of at least 40° C./s, preferably 50 to 250° C./s, and more preferably 75 to 125° C./s, followed by conducting decarburization annealing at a temperature and over a time period that produce primary recrystallization grains having a diameter in the range 7 to 18 μm.

EXAMPLES

Examples of the invention are described in the following. One example of conditions is used to confirm the implementation potential and effect of the invention. The invention is not limited to these examples, and various conditions may be employed to the extent that the object of the invention is achieved without departing from the scope of the invention.

Example 1

Slabs containing, in mass %, Si: 3.2%, C, 0.05%, acid-soluble Al: 0.024%, N: 0.005%, Mn: 0.04%, S: 0.01% and the balance of Fe and unavoidable impurities were heated to 1320° C. (in the case of this composition system, T1=1242° C., T2=1181° C.) and hot-rolled to a thickness of 2.3 mm. Then, one-stage annealing was conducted on some specimens (A) at 1130° C., and two-stage annealing was conducted on some specimens (B) at 1130° C.+920° C. The specimens were cold-rolled to a thickness of 0.3 mm, and were then heated to 720° C. at a heating rate of (1) 15° C./s, (2) 40° C./s, and (3) 100° C./s, then heated to 850° C. at 10° C./s, decarburization-annealed and annealed in an ammonia-containing gaseous atmosphere, increasing the nitrogen in the steel sheet to 0.02%. The specimens were then coated with an annealing separator having MgO as its main component, and finish-annealed.

Table 1 shows the magnetic properties of the specimens after finish-annealing. The specimen symbols denote the combination of annealing method and heating rate. When both the hot-rolled sheet annealing and decarburization annealing conditions of the invention were satisfied, high magnetic flux density was obtained.

TABLE 1

| Specimen | Lamella spacing (μm) | Magnetic flux density B8 (T) | Remarks |
|---|---|---|---|
| (A-1) | 15 | 1.897 | Comparative example |
| (A-2) | 15 | 1.901 | Comparative example |
| (A-3) | 15 | 1.903 | Comparative example |
| (B-1) | 26 | 1.917 | Comparative example |
| (B-2) | 26 | 1.924 | Invention example |
| (B-3) | 26 | 1.931 | Invention example |

Example 2

Slabs containing, in mass %, Si: 3.2%, C: 0.055%, acid-soluble Al: 0.026%, N: 0.005%, Mn: 0.04%, S: 0.015% and the balance of Fe and unavoidable impurities were heated to 1330° C. (in the case of this composition system, T1=1250° C., T2=1206° C., T4=1212° C.) and hot-rolled to a thickness of 2.3 mm. Then, one-stage annealing was conducted on some specimens (A) at 1120° C., and two-stage annealing was conducted on some specimens (B) at 1120° C.+900° C. The specimens were cold-rolled to a thickness of 0.3 mm, and were then heated to 550° C. at a heating rate of 20° C./s, then further heated from 550° C. to 720° C. at (1) 15° C./s, (2) 40° C./s, and (3) 100° C./s, then further heated to 840° C. at 15° C./s and decarburization-annealed at that temperature and annealed in an ammonia-containing gaseous atmosphere, increasing the nitrogen in the steel sheet to 0.02%. The specimens were then coated with an annealing separator having MgO as its main component, and finish-annealed.

Table 2 shows the magnetic properties of the specimens after finish-annealing. When both the hot-rolled sheet annealing and decarburization annealing conditions of the invention were satisfied, high magnetic flux density was obtained.

TABLE 2

| Specimen | Lamella spacing (μm) | Magnetic flux density B8 (T) | Remarks |
|---|---|---|---|
| (A-1) | 18 | 1.883 | Comparative example |
| (A-2) | 18 | 1.902 | Comparative example |
| (A-3) | 18 | 1.909 | Comparative example |
| (B-1) | 24 | 1.919 | Comparative example |

TABLE 2-continued

| Specimen | Lamella spacing (μm) | Magnetic flux density B8 (T) | Remarks |
|---|---|---|---|
| (B-2) | 24 | 1.933 | Invention example |
| (B-3) | 24 | 1.952 | Invention example |

Example 3

Following hot rolling, specimens fabricated in Example 2 were subjected to two-stage annealing at 1120° C.+900° C. to produce a lamella spacing of 24 μm. The specimens were cold-rolled to a thickness of 0.3 mm, and were then heated to 550° C. at a heating rate of 20° C./s, further heated from 550° C. to 720° C. at 40° C./s, and then further heated to 840° C. at 15° C./s and decarburization-annealed at that temperature, which was followed by annealing in an ammonia-containing gaseous atmosphere, increasing the nitrogen in the steel sheet 0.008 to 0.020%. The specimens were then coated with an annealing separator having MgO as its main component, and finish-annealed.

Table 3 shows the magnetic properties, after finish-annealing, of the specimens having different nitrogen amounts.

TABLE 3

| Specimen | Nitrogen amount (%) | [N]/[Al] | Magnetic flux density B8 (T) | Remarks |
|---|---|---|---|---|
| (A) | 0.008 | 0.31 | 1.623 | Comparative example |
| (B) | 0.011 | 0.42 | 1.790 | Comparative example |
| (C) | 0.017 | 0.65 | 1.929 | Invention example |
| (D) | 0.020 | 0.77 | 1.933 | Invention example |

Example 4

Specimens comprised of cold-rolled sheets fabricated in Example 3 were heated to 720° C. at a heating rate of 40° C./s, and were then further heated, and decarburization-annealed at a temperature of 800° C. to 900° C., which was followed by annealing in an ammonia-containing gaseous atmosphere, increasing the nitrogen in the steel sheet to 0.02%. The specimens was then coated with an annealing separator having MgO as its main component, and finish-annealed. Table 4 shows the magnetic properties, after finish-annealing, of the specimens having different primary recrystallization grain diameters after decarburization annealing.

TABLE 4

| Specimen | Decarburization temperature (° C.) | Grain diameter after decarburization annealing (μm) | Magnetic flux density B8 (T) | Remarks |
|---|---|---|---|---|
| (A) | 800 | 6.3 | 1.872 | Comparative example |
| (B) | 840 | 9.8 | 1.941 | Invention example |
| (C) | 870 | 13.4 | 1.937 | Invention example |
| (D) | 900 | 19.9 | 1.903 | Comparative example |

Example 5

Slabs containing, in mass %, Si: 3.2%, C, 0.055%, acid-soluble Al: 0.026%, N: 0.006%, Mn: 0.05%, S: 0.05%, Se: 0.015%, Sn: 0.1% and the balance of Fe and unavoidable impurities were heated to 1330° C. (in the case of this composition system, T1=1269° C., T2=1152° C., T3=1217° C.) and hot-rolled to a thickness of 2.3 mm. Then, one-stage annealing was conducted on some specimens (A) at 1130° C., and two-stage annealing was conducted on some specimens (B) at 1130° C.+920° C. The specimens were cold-rolled to a thickness of 0.3 mm, and were then heated to 550° C. at a heating rate of 20° C./s, and then from 550° C. to 720° C. at a heating rate of (1) 15° C./s, (2) 100° C./s, then further heated to 840° C. at 15° C./s and decarburization-annealed at that temperature, then annealed in an ammonia-containing gaseous atmosphere, increasing the nitrogen in the steel sheet to 0.018%. The specimens were then coated with an annealing separator having MgO as its main component, and finish-annealed.

Table 5 shows the magnetic properties of the specimens after finish-annealing. When both the hot-rolled sheet annealing and decarburization annealing conditions of the invention were satisfied, high magnetic flux density was obtained.

TABLE 5

| Specimen | Lamella spacing (μm) | Magnetic flux density B8 (T) | Remarks |
|---|---|---|---|
| (A-1) | 17 | 1.883 | Comparative example |
| (A-2) | 17 | 1.899 | Comparative example |
| (B-1) | 25 | 1.917 | Comparative example |
| (B-2) | 25 | 1.943 | Invention example |

Example 6

Slabs containing, in mass %, Si: 3.2%, C, 0.05%, acid-soluble Al: 0.024%, N: 0.005%, Mn: 0.04%, S: 0.01% and the balance of Fe and unavoidable impurities were heated to 1320° C. (in the case of this composition system, T1=1242° C., T2=1181° C.), hot-rolled to a thickness of 2.3 mm, and annealed at 1100° C. During this, water vapor was blown into the gaseous atmosphere (a mixed gas of nitrogen and hydrogen), effecting decarburization from the surface, changing the lamella spacing of the surface layer. These specimens were cold-rolled to a thickness of 0.3 mm, then heated to 720° C. at a heating rate of 100° C./s, after which they were heated to 850° C. at 10° C./s and decarburization-annealed, then annealed in an ammonia-containing gaseous atmosphere, increasing the nitrogen in the steel sheet to 0.018%. The specimens were then coated with an annealing separator having MgO as its main component, and finish-annealed.

Table 6 shows the magnetic properties, after finish-annealing, of the specimens having different surface layer lamella spacings.

TABLE 6

| Specimen | Surface layer lamella spacing (μm) | Magnetic flux density B8 (T) | Remarks |
|---|---|---|---|
| (A) | 13 | 1.883 | Comparative example |
| (B) | 23 | 1.927 | Invention example |
| (C) | 31 | 1.941 | Invention example |
| (D) | 39 | 1.943 | Invention example |

Example 7

Following hot rolling, specimens fabricated in Example 6 were annealed at 1100° C. During this, water vapor was blown into the gaseous atmosphere (a mixed gas of nitrogen and hydrogen), effecting decarburization from the surface, adjusting the lamella spacing of the surface layer into two types, (A) and (B). These specimens were cold-rolled to a thickness of 0.3 mm, then heated to 720° C. at a heating rate of (1) 15° C./s, and (2) 40° C./s, after which they were heated to 850° C. at 10° C./s and decarburization-annealed, then annealed in an ammonia-containing gaseous atmosphere, increasing the nitrogen in the steel sheet to 0.02%. The specimens were then coated with an annealing separator having MgO as its main component, and finish-annealed.

Table 7 shows the magnetic properties of the specimens after finish-annealing. The specimen symbols denote the combination of surface layer lamella spacing and heating rate. When both the hot-rolled sheet annealing and decarburization annealing conditions of the invention were satisfied, high magnetic flux density was obtained.

TABLE 7

| Specimen | Surface layer lamella spacing (μm) | Magnetic flux density B8 (T) | Remarks |
|---|---|---|---|
| (A-1) | 13 | 1.893 | Comparative example |
| (A-2) | 13 | 1.891 | Comparative example |
| (B-1) | 31 | 1.913 | Comparative example |
| (B-2) | 31 | 1.929 | Invention example |

Example 8

Slabs containing, in mass %, Si: 3.2%, C: 0.055%, acid-soluble Al: 0.026%, N: 0.005%, Mn: 0.05%, Cu: 0.1%, S: 0.012% and the balance of Fe and unavoidable impurities were heated to 1330° C. (in the case of this composition system, T1=1250° C., T2=1206° C., T4=1212° C.) and hot-rolled to a thickness of 2.3 mm. Then, annealing was conducted at a temperature of 1100° C. During this, water vapor was blown into the gaseous atmosphere (a mixed gas of nitrogen and hydrogen), effecting decarburization from the surface, adjusting the lamella spacing of the surface layer into two types, (A) and (B). These specimens were cold-rolled to a thickness of 0.3 mm, heated to 550° C. at a heating rate of 20° C./s, then further heated from 550° C. to 720° C. at a heating rate of (1) 15° C./s, (2) 40° C./s, and (3) 100° C./s, after which they were heated to 840° C. at a heating rate of 15° C./s and decarburization-annealed, then annealed in an ammonia-containing gaseous atmosphere, increasing the nitrogen in the steel sheet to 0.02%. The specimens were then coated with an annealing separator having MgO as its main component, and finish-annealed.

Table 8 shows the magnetic properties of the specimens after finish-annealing. When both the hot-rolled sheet annealing and decarburization annealing conditions of the invention were satisfied, high magnetic flux density was obtained.

TABLE 8

| Specimen | Lamella spacing (μm) | Magnetic flux density B8 (T) | Remarks |
|---|---|---|---|
| (A-1) | 12 | 1.822 | Comparative example |
| (A-2) | 12 | 1.840 | Comparative example |
| (A-3) | 12 | 1.869 | Comparative example |

TABLE 8-continued

| Specimen | Lamella spacing (μm) | Magnetic flux density B8 (T) | Remarks |
|---|---|---|---|
| (B-1) | 26 | 1.914 | Comparative example |
| (B-2) | 26 | 1.931 | Invention example |
| (B-3) | 26 | 1.939 | Invention example |

Example 9

Following hot rolling, specimens fabricated in Example 8 were annealed at 1100° C. During this, water vapor was blown into the gaseous atmosphere (a mixed gas of nitrogen and hydrogen), effecting decarburization from the surface to produce a lamella spacing of 27 μm. These specimens were cold-rolled to a thickness of 0.3 mm, then heated to 550° C. at a heating rate of 20° C./s, and were further heated from 550° C. to 720° C. at a heating rate of 40° C./s, after which they were heated to 850° C. at a heating rate of 15° C./s and decarburization-annealed, then annealed in an ammonia-containing gaseous atmosphere, increasing the nitrogen in the steel sheet to 0.08% to 0.02%. The specimens were then coated with an annealing separator having MgO as its main component, and finish-annealed.

Table 9 shows the magnetic properties, after finish-annealing, of the specimens having different nitrogen amounts.

TABLE 9

| Specimen | Nitrogen amount (%) | [N]/[Al] | Magnetic flux density B8 (T) | Remarks |
|---|---|---|---|---|
| (A) | 0.008 | 0.31 | 1.609 | Comparative example |
| (B) | 0.011 | 0.42 | 1.710 | Comparative example |
| (C) | 0.017 | 0.65 | 1.923 | Invention example |
| (D) | 0.020 | 0.77 | 1.929 | Invention example |

Example 10

Specimens comprised of cold-rolled sheets fabricated in Example 9 were heated to 720° C. at a heating rate of 40° C./s, and were further heated from 800° C. to 900° C. at a heating rate of 15° C./s, then annealed in an ammonia-containing gaseous atmosphere, increasing the nitrogen in the steel sheet to 0.02%. The specimens were then coated with an annealing separator having MgO as its main component, and finish-annealed.

Table 10 shows the magnetic properties, after finish-annealing, of the specimens having different primary recrystallization grain diameters following decarburization annealing.

TABLE 10

| Specimen | Decarburization annealing temp. (° C.) | Grain diameter after decarburization annealing (μm) | Magnetic flux density B8 (T) | Remarks |
|---|---|---|---|---|
| (A) | 800 | 6.3 | 1.832 | Comparative example |
| (B) | 840 | 9.8 | 1.931 | Invention example |

TABLE 10-continued

| Specimen | Decarburization annealing temp. (° C.) | Grain diameter after decarburization annealing (μm) | Magnetic flux density B8 (T) | Remarks |
|---|---|---|---|---|
| (C) | 870 | 13.4 | 1.929 | Invention example |
| (D) | 900 | 19.9 | 1.815 | Invention example |

Example 11

Slabs containing, in mass %, Si: 3.2%, C, 0.055%, acid-soluble Al: 0.026%, N: 0.006%, Mn: 0.05%, S: 0.05%, Se: 0.015%, Sn: 0.1% and the balance of Fe and unavoidable impurities were heated to 1330° C. (in the case of this composition system, T1=1269° C., T2=1152° C., T3=1217° C.) and hot-rolled to a thickness of 2.3 mm. Then the specimens were annealed at 1080° C. in a dry gaseous atmosphere of nitrogen and hydrogen, with some specimens (A) as-is some specimens (B) with a coating of $K_2CO_3$ applied. The specimens were cold-rolled to a thickness of 0.3 mm, and were then heated to 550° C. at a heating rate of 20° C./s, heated from 550° C. to 720° C. at a heating rate of 100° C./s, and further heated to 840° C. at 15° C./s and decarburization-annealed at that temperature, then annealed in an ammonia-containing gaseous atmosphere, increasing the nitrogen in the steel sheet to 0.018%. The specimens were then coated with an annealing separator having MgO as its main component, and finish-annealed.

Table 11 shows the magnetic properties, after finish-annealing, of the specimens having different surface layer lamella spacings.

TABLE 11

| Specimen | Surface layer lamella spacing (μm) | Magnetic flux density B8 (T) | Remarks |
|---|---|---|---|
| (A) | 16 | 1.821 | Comparative example |
| (B) | 27 | 1.939 | Invention example |

Example 12

Specimens were comprised of cold-rolled sheets fabricated in Example 3. The cold-rolled sheets were heated to (1) 500° C., (2) 550° C., and (3) 600° C. at heating rates of (A) 15° C./s and (B) 50° C./s, then heated to 720° C. at a heating rate of 100° C./s, and further heated to 830° C. at a heating rate of 10° C./s and decarburization-annealed. They were then annealed in an ammonia-containing gaseous atmosphere, increasing the nitrogen in the steel sheet to 0.018%. The specimens were then coated with an annealing separator having MgO as its main component, and finish-annealed.

Table 12 shows the magnetic properties of the specimens after finish-annealing. This shows that by increasing the heating rate in a low-temperature region, it was possible to obtain good magnetic properties even when the temperature at which heating at 100° C./s is started is raised to 600° C.

TABLE 12

| Specimen | Low-temperature heating rate (° C.) | Heating starting temp. at 100° C./s | Magnetic flux density B8 (T) | Remarks |
|---|---|---|---|---|
| (A-1) | 15 | 500 | 1.952 | Invention example |
| (A-2) | 15 | 550 | 1.950 | Invention example |
| (A-3) | 15 | 600 | 1.913 | Comparative example |
| (B-1) | 50 | 500 | 1.953 | Invention example |
| (B-2) | 50 | 550 | 1.952 | Invention example |
| (B-3) | 50 | 600 | 1.953 | Invention example |

In accordance with this invention, by using a two-stage temperature range to conduct hot-rolled sheet annealing in the manufacture of grain-oriented electrical steel sheet using low-temperature slab heating, the upper limit of the range of control of the heating rate used in the temperature elevation process of the decarburization annealing to improve the grain structure following primary recrystallization after decarburization annealing can be set to a lower temperature range in which heating can be conducted using just induction heating. Thus the heating can be done more readily by using induction heating, making it possible readily to stably manufacture grain-oriented electrical steel sheet having good magnetic properties with a high magnetic flux density. The invention therefore has major industrial applicability.

What is claimed is:

1. A method of production of grain-oriented electrical steel sheet comprising: heating silicon steel containing, in mass %, Si: 0.8 to 7%, C: up to 0.085%, acid-soluble Al: 0.01 to 0.065%, N: up to 0.075%, Mn: 0.02 to 0.20%, S equivalent=S+0.406×Se: 0.003 to 0.05% to a temperature ranging from the lowest of temperatures T1, T2, and T3 to not more than 1350° C., wherein $$T1=10062/(2.72-\log([Al]\times[N]))-273;$$

$$T2=14855/(6.82-\log([Mn]\times[S]))-273;\text{ and}$$

$$T3=10733/(4.08-\log([Mn]\times[Se]))-273;\text{ and wherein}$$

[Al] is the mass % of Al, [N] is the mass % of N, [Mn] is the mass % of Mn, [S], is the mass % of S, [Se] is the mass % of Se, and T1, T2, and T3 are measured in ° C.;

hot rolling the heated silicon steel, producing a hot-rolled steel sheet;

recrystallizing the hot-rolled sheet by heating to a temperature of 1000° C. to 1150° C.;

then annealing the hot-rolled steel sheet at a temperature of 850° C. to 1100° C. to control lamella spacing in a grain structure of the annealed hot-rolled steel to at least 20 μm;

subjecting the annealed hot-rolled steel sheet to one cold rolling or a plurality of cold rollings with intermediate annealing to form a cold-rolled steel sheet of a final thickness, decarburization annealing the cold-rolled steel sheet, wherein, during the decarburization annealing, the cold-rolled steel sheet is heated in a temperature range of from 550° C. to 720° C. in a heating process consisting of only induction heating at a heating rate of at least 40° C./s;

coating the decarburized steel sheet with an annealing separator, conducting finish annealing and a process to increase an amount of nitrogen in the steel sheet after decarburization annealing and before initiation of a secondary recrystallization in the finish annealing.

2. A method of production of grain-oriented electrical steel sheet comprising: heating silicon steel containing, in mass %, Si: 0.8 to 7%, C: up to 0.085%, acid-soluble Al: 0.01 to 0.065%, N: up to 0.075%, Mn: 0.02 to 0.20%, S equivalent=S+0.406×Se: 0.003 to 0.05% to a temperature ranging from the lowest of temperatures T1, T2, and T3 to not more than 1350° C., wherein $$T1=10062/(2.72-\log([Al]\times[N]))-273;$$

$$T2=14855/(6.82-\log([Mn]\times[S]))-273;\text{ and}$$

$$T3=10733/(4.08-\log([Mn]\times[Se]))-273;\text{ and wherein}$$

[Al] is the mass % of Al, [N] is the mass % of N, [Mn] is the mass % of Mn, [S], is the mass % of S, [Se] is the mass % of Se, and T1, T2, and T3 are measured in ° C.;

hot rolling the heated silicon steel, producing a hot-rolled steel sheet;

annealing the hot-rolled steel sheet; wherein, in the hot-rolled sheet annealing process, 0.002 to 0.02 mass percent of the carbon present in the steel sheet prior to decarburization is decarburized to control lamella spacing in the annealed surface structure to be 20 μm or more;

subjecting the annealed hot-rolled steel sheet to one cold rolling or a plurality of cold rollings with intermediate annealing to form a cold-rolled steel sheet of a final thickness, decarburization annealing the cold-rolled steel sheet, wherein, during the decarburization annealing, the cold-rolled steel sheet is heated in a temperature range of from 550° C. to 720° C. in a heating process consisting of only induction heating at a heating rate of at least 40° C./s;

coating the decarburized steel sheet with an annealing separator, applying finish annealing and a process to increase an amount of nitrogen in the steel sheet after decarburization annealing and before initiation of a secondary recrystallization in finish annealing.

3. A method of production of grain-oriented electrical steel sheet as set forth in claim 1, wherein the silicon steel further contains, in mass %, Cu: 0.01 to 0.30% and is hot-rolled after being heated to a temperature that is at least T4, wherein T4=43091/(25.09−log([Cu]×[Cu]×[S]))−273, and wherein [Cu] is the Cu content in mass %, and T4 is measured in ° C.

4. A method of production of grain-oriented electrical steel sheet as set forth in claim 1, wherein in the decarburization annealing of the cold-rolled steel sheet, the cold-rolled steel sheet is heated in the temperature range of from 550° C. to 720° C. at a heating rate of 50° to 250° C./s.

5. A method of production of grain-oriented electrical steel sheet as set forth in claim 1, wherein in the decarburization annealing of the cold-rolled steel sheet, heating in the range of from 550° C. to 720° C. is by induction heating.

6. A method of production of grain-oriented electrical steel sheet as set forth in claim 1, wherein the steel sheet is heated from room temperature to 500° C. during the decarburization annealing where the steel sheet is heated from a temperature of Ts (° C.) to 720° C. at a heating rate H (° C./s) of ≦15° C./s when is Ts≦550° and at a heating rate H>15° C./s when Ts≦600° C.

7. A method of production of grain-oriented electrical steel sheet as set forth in claim 1, wherein decarburization annealing is carried out at a temperature and length of time that provides a decarburization-annealed primary recrystallization grain diameter of from 7 μm to less than 18 μm.

8. A method of production of grain-oriented electrical steel sheet as set forth in claim 1, wherein a process of increasing an amount of nitrogen [N] of the steel sheet is carried out to satisfy a formula [N]≧14/27 [Al] corresponding to amount of acid-soluble Al [Al] of the steel sheet.

9. A method of production of grain-oriented electrical steel sheet as set forth in claim 1, wherein the silicon steel sheet further contains, in mass %, one or more of Cr: up to 0.3%, P: up to 0.5%, Sn: up to 0.3%, Sb: up to 0.3%, Ni: up to 1%, and Bi: up to 0.01%.

* * * * *